United States Patent [19]

Strasser et al.

[11] Patent Number: 4,803,845

[45] Date of Patent: Feb. 14, 1989

[54] CONTROLLABLE THROTTLE FOR A VACUUM PUMP

[75] Inventors: Wilhelm Strasser, Bergisch Gladbach; Axel Veit, Pulheim, both of Fed. Rep. of Germany

[73] Assignee: Leybold Aktiengesellschaft, Cologne, Fed. Rep. of Germany

[21] Appl. No.: 148,629

[22] Filed: Jan. 26, 1988

[30] Foreign Application Priority Data

Jan. 28, 1987 [EP] European Pat. Off. ... EP 87101153.2

[51] Int. Cl.[4] ..... B01D 8/00

[52] U.S. Cl. ..... 62/55.5; 55/269; 62/268; 74/424.8 VA; 137/601; 251/129.11; 251/228; 417/901

[58] Field of Search ..... 62/55.5, 268, 100; 55/269; 417/901; 137/565, 601; 251/129.11, 228, 247, 231; 74/428 VA

[56] References Cited

U.S. PATENT DOCUMENTS

| | | | |
|---|---|---|---|
| 3,973,590 | 8/1976 | Logsdon | 137/601 |
| 4,064,934 | 12/1977 | Kolthoff, Jr. et al. | 137/601 |
| 4,341,079 | 7/1982 | Bonn | 62/55.5 |
| 4,393,896 | 7/1983 | Slabaugh | 137/601 |
| 4,457,336 | 7/1984 | Allan et al. | 137/601 |
| 4,475,349 | 10/1984 | Batzer et al. | 62/55.5 |
| 4,479,361 | 10/1984 | Osher | 62/55.5 |
| 4,493,342 | 1/1985 | Bachmann | 137/601 |
| 4,531,372 | 7/1985 | Slabaugh | 62/55.5 |

FOREIGN PATENT DOCUMENTS

| | | |
|---|---|---|
| 102787 | 3/1984 | European Pat. Off. . |
| 2936931 | 3/1980 | Fed. Rep. of Germany . |
| 3216591 | 11/1983 | Fed. Rep. of Germany . |

*Primary Examiner*—Ronald C. Capossela
*Attorney, Agent, or Firm*—Spencer & Frank

[57] ABSTRACT

A throttle valve with a separate flange, usable with a vacuum pump defining an inlet opening, and a controllable throttle assembly for varying a flow passage cross section of the inlet opening. The throttle assembly is disposed in the inlet opening and has a plurality of slats rotatable about respective longitudinal axes for varying their inclination and an actuating rod for turning the slats. The flange has a throughgoing bore through which the actuating rod passes. The slats have a substantially constant width and their longitudinal axes are oriented parallel to one another. The slats form a first and a second slat group, and a linkage connects the slats with one another for turning the slats of the first slat group and the slats of the second slat group in opposite directions. A chamber is situated externally of the inlet opening and communicates with the throughgoing bore. A pivotal lever articulated to the actuating rod is situated in the chamber and projects outwardly therefrom. There is further provided a swingable bellows supported in the chamber and surrounding the pivotal lever for providing an airtight separation of at least one part of the pivotal lever from the chamber.

8 Claims, 2 Drawing Sheets

CONTROLLABLE THROTTLE FOR A VACUUM PUMP

BACKGROUND OF THE INVENTION

This invention relates to a controllable throttle assembly for a vacuum pump, particularly a cryopump.

The throttle assembly has a frame which is secured in a separate, generally circular flange and which supports strip-like elements (slats) rotatable about their longitudinal axes and are thus adjustable in their inclination. The inclined position of the slats may be adjusted by an actuating rod which passes through a radially oriented bore provided in the flange.

A throttle valve of the above-outlined type is disclosed, for example, in published European Application No. 102,787. The construction disclosed therein comprises sector-shaped slats which are arranged in a star-like manner and which are disposed within the flange for rotation about their longitudinal axis. The common actuation of the slats is effected by means of a cable which is guided over discs connected at their radially outer portion with the sector-shaped shutoff slats. One of the discs is provided with a shaft projecting outwardly through a bore in the flange. The throttle valve is actuated by rotating the shaft.

It is a disadvantage of a throttle valve of the above-outlined type that it is of relatively tall construction and requires a plurality of sector slats which are moved in a coordinated manner relative to one another. While it is feasible to reduce the number of the sector slats, such a solution would result in an even taller throttle construction because the smaller the number of the sector slats the greater the maximum width thereof. A sealing of the shaft which is required for the transfer of the rotary motion and which projects outwardly through the flange is wrought with difficulties in pumps where the usual high vacuum conditions must prevail. It is a further disadvantage of the above-discussed prior art construction that the cable which is exposed to significant temperature fluctuations does not operate reliably over an extended period of time.

In German Offenlegungsschriften (Non-examined Published Patent Applications) Nos. 2,936,931 and 3,216,591 throttles are disclosed which are fixedly installed in cryopumps having at least two stages. These throttles are in each instance situated in the zone of the inlet opening of the cryopump and have essentially two functions. First, the components of the throttle constitute pumping surfaces for gases with relatively high condensation temperatures (referred to hereafter generally as vapors), such as, for example, water vapor. In order to bind such vapors with cryo-condensation, the throttle is connected by means of a good heat conductor with the first stage of a refrigerator. As a result, the throttle has an operating temperature of approximately 50 K. to 80 K. Second, the fixedly installed throttles have the task to protect the inner pumping surfaces in case of the presence of excessive vapor. The inner pumping surfaces have a temperature of approximately 10 K. to 30 K. and serve essentially for the cryo-condensation of low boiling-point heavy gases (hereafter referred to as permanent gases), for example, argon. Additionally, on inner pumping surfaces an adsorption material is provided for adsorbing light gases such as hydrogen and helium. When a periodically significantly increased vapor proportion is present, for example, during sputtering processes (for which cryopumps are increasingly used), and if the vapors gain access to the inner pumping surfaces, the latter will be covered with ice in a short period of time and, as a disadvantageous result, the permanent and light gases can no longer be effectively pumped.

The throttle valve disclosed in German Offenlegungsschrift No. 2,936,931 is a shutter construction having a stator plate and a rotor plate. Each plate has spoke-like arranged sector-shaped openings whose magnitude is so selected that the openings of the stator plate may be opened or closed by turning the rotor plate. In case of an increased vapor presence the throttle is brought into its closed position whereby the inner pumping surfaces are protected. A throttle structured in this manner may, in its maximum open position, free at the most 40% of the inlet opening area of a cryopump thus presenting, even in the fully open state, a relatively large obstacle for the inflowing permanent gases. Further, a throttle of this type is not adapted to additionally perform the function of a baffle which has the task to protect the cold surfaces in the pump housing from direct heat radiation. If such a protection is desired, then, in addition to the throttle disclosed in German Offenlegungsschrift No. 2,936,931, a baffle must be used which provides for an "optical screening". The conventional baffles occupy approximately 50% of the inlet opening so that the baffle and the throttle together block 90% of the path leading to the inner cold surfaces. A further reduction of the evacuation capacity occurs by virtue of the necessity to arrange the baffle and throttle behind one another which results in relatively long pumping paths. The practically achievable permanent suction capacity of a cryopump equipped with a baffle and throttle is therefore, in the fully open state of the throttle, maximum 20% of the theoretically possible suction capacity.

A throttle which is fixedly installed in a cryopump, as disclosed in German Offenlegungsschrift No. 3,216,591 (FIGS. 3 and 4), includes parallel-arranged slats whose inclination may be varied. The actuation of the slats is effected by means of a cable which is guided into a lateral chamber through a nipple provided for this purpose at the pump housing. Within the chamber there is disposed a rotatable disc to which the cable is attached. In this prior art construction too, the cable exposed to the significant temperature fluctuations cannot reliably operate for an extended period. The actuating rotary component requires a vacuumtight rotary passage therefor. This construction further has the disadvantage that a cryopump having a fixedly installed throttle of the prior art structure is, as compared to a cryopump in which a controllable throttling of the suction capacity is not required, inordinately complex and thus expensive because, in particular, there are required a separate coupling nipple for guiding the cable, a vacuumtight rotary joint and an increased structural height.

SUMMARY OF THE INVENTION

It is an object of the invention to provide an improved throtte valve of the above-outlined type from which the discussed disadvantages are eliminated.

This object and others to become apparent as the specification progresses, are accomplished by the invention, according to which, briefly stated, the throttle valve has a flange separate from the vacuum pump, defining an inlet opening, and a controllable throttle assembly for varying a flow passage cross section of the inlet opening. The throttle assembly is disposed in the inlet opening and has a plurality of slats rotatable about respective longitudinal axes for varying their inclination and an actuating rod for turning the slats. The flange has a throughgoing bore through which the actuating rod passes. The slats have a substantially constant width and their longitudinal axes are oriented parallel to one another. The slats form a first and a second slat group, and a linkage connects the slats with one another for turning the slats of the first slat group and the slats of the second slat group in opposite directions. A chamber is situated externally of the inlet opening and communicates with the throughgoing bore. A pivotal lever articulated to the actuating rod is situated in the chamber and projects outwardly therefrom. There is further provided a swingable bellows supported in the chamber and surrounding the pivotal lever for providing an airtight separation of at least one part of the pivotal lever from the chamber.

A throttle structured according to the invention constitutes a completely independent modular structural component which has relatively few individual components, yet may be opened to a relatively large degree. Rotary passages with a high vacuum seal as well as cables of uncertain performance are no longer required. The height of the outer flange may be maintained very small. The throttle according to the invention may be installed in the inlet opening of commercially available vacuum pumps without thereby significantly increasing the entire structural height thereof. The use of the throttle according to the invention for regulating the suction capacity of cryopumps is of particular advantage. Separate manufacturing specifications are no longer necessary. The throttle according to the invention is not only capable of performing the two functions of presenting pumping surfaces for vapors and protecting the inner pumping surfaces during increased vapor presence, but is—with an appropriate design of the inner pumping surfaces—also able to assume the function of a baffle to protect the inner pumping surfaces from direct heat radiation.

DESCRIPTION OF THE PREFERRED EMBODIMENT

Figures 1, 3:
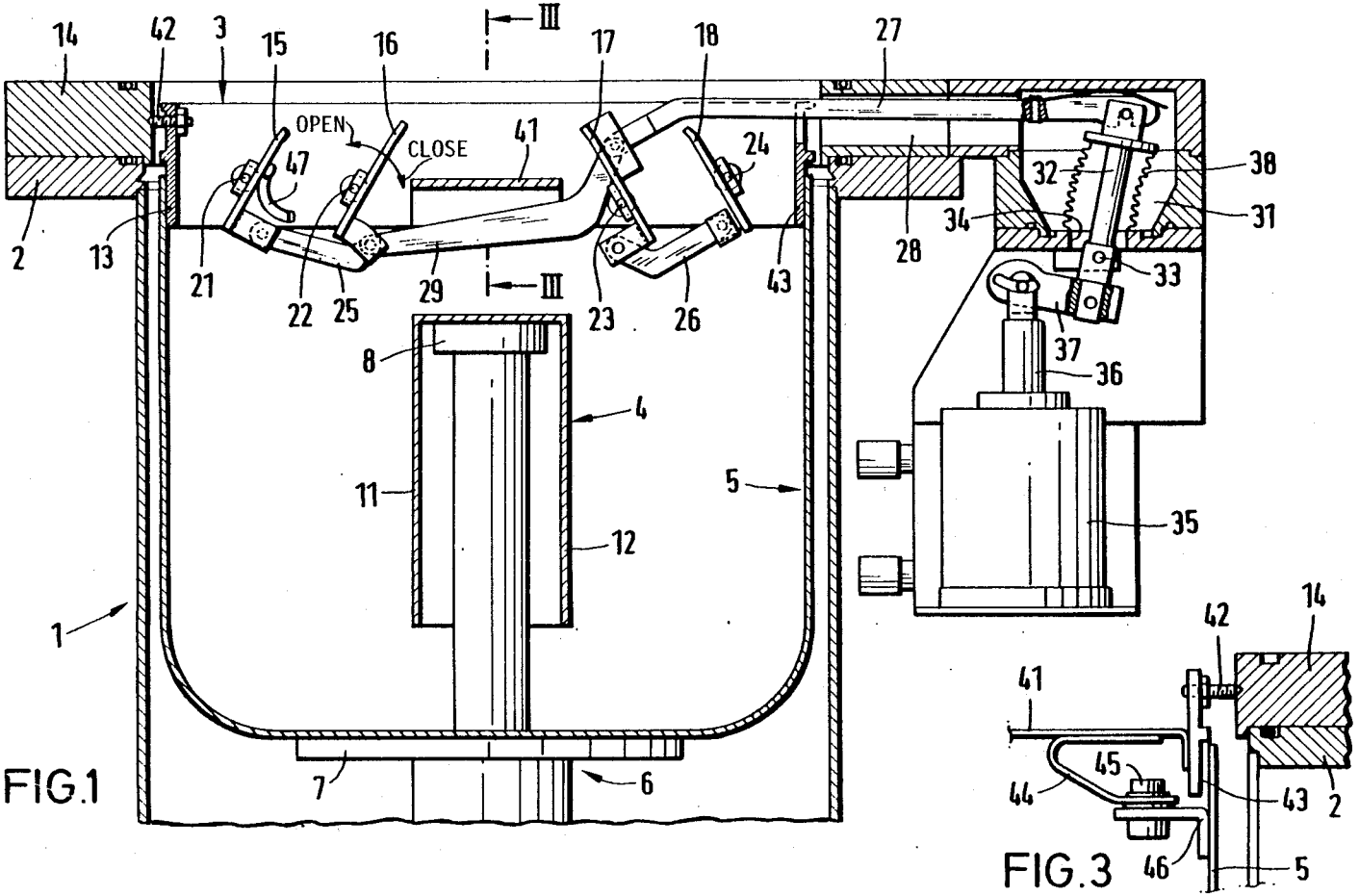
FIG. 1 is a sectional side elevational view of a preferred embodiment of the invention.
FIG. 3 is a sectional view taken along line III—III of FIG. 1.

Turning now to FIG. 1, there is shown the upper part of a cryopump 1 which has a flange 2 that defines an inlet opening.

A throttle assembly generally designated at 3 is installed inside the flange 2.

The pumping surfaces 4 and 5 of the cryopump 1 are cooled by means of a two-stage refrigerator 6. The pumping surface 5 secured to the first stage 7 of the refrigerator 6 is bowl-shaped and surrounds the second stage 8 as well as the pumping surfaces 4 secured thereto. During the operation of the pump the bowl-shaped pumping surface 5 arranged with insulation in the pump housing 1 assumes a temperature of approximately 50–80 K. so that on these surfaces vapors may be bound by cryo-condensation. The inner pumping surfaces 4 are formed of two parallel-arranged planar plate portions 11 and 12 which are connected by means of a good heat conductor with the second refrigerator stage 8. As a result of this arrangement, during operation of the cryopump the pumping surfaces 11 and 12 have a temperature of approximately 10 K. to 20 K. On these pumping surfaces permanent gases are deposited by cryo-condensation. If the inner faces of the plates 11 and 12 are, for example, coated with active carbon, a cryosorption of light gases occurs.

The throttle 3 constructed according to the invention includes a flange 14 by means of which it is set on the flange 2 of the cryopump. Within the flange 14 there is held a frame 13 to which there are secured parallel-oriented slats 15, 16, 17 and 18, each rotatable about respective longitudinal axes 21, 22, 23 and 24. The slat groups formed of the two slats 15 and 16 on the one hand and of the two slats 17 and 18 move in opposite directions relative to one another and are coupled to one another by means of respective levers 25 and 26. For effecting rotation of the slats an actuating rod 27 is provided which passes outwardly through a bore 28 provided in the flange 14. The actuating rod 27 is articulated to the slat 17 above the rotary axes 21–24. To the same articulation there is jointed one end of a reversing lever 29, whose other end is articulated underneath the rotary axes 21–24 to the slat 16 of the other slat group. A longitudinal shifting of the actuating rod 27 effects, by virtue of the linkage system formed of levers 25, 26 and 29 the desired opposite motion of the slat groups 15, 16 on the one hand and 17, 18 on the other hand.

The bore 28 in the flange 14 is adjoined by a vacuum-tight chamber 31 which communicates with the inner chamber of the pump via the bore 28. Within the chamber 31 the actuating rod 27 is articulated to a pivotal lever 32 oriented substantially perpendicularly to the actuating rod 27. The stationary pivotal axis of the pivotal lever 32 is designated at 33. With the pivotal lever 32 which projects from the chamber 31 through an opening 34 there is associated an electric, pneumatic or similar power drive 35 whose drive shaft 36 is arranged to exert a force on the pivotal lever 32 with the intermediary of a coupling lever 37. For sealing the opening 34 against the inside of the chamber 31 a swingable bellows 38 is provided which is connected, at one end, with a collar of the pivotal lever 32 and is, on the other end, attached vacuumtight to the chamber wall to surround the opening 34.

Figure 2:
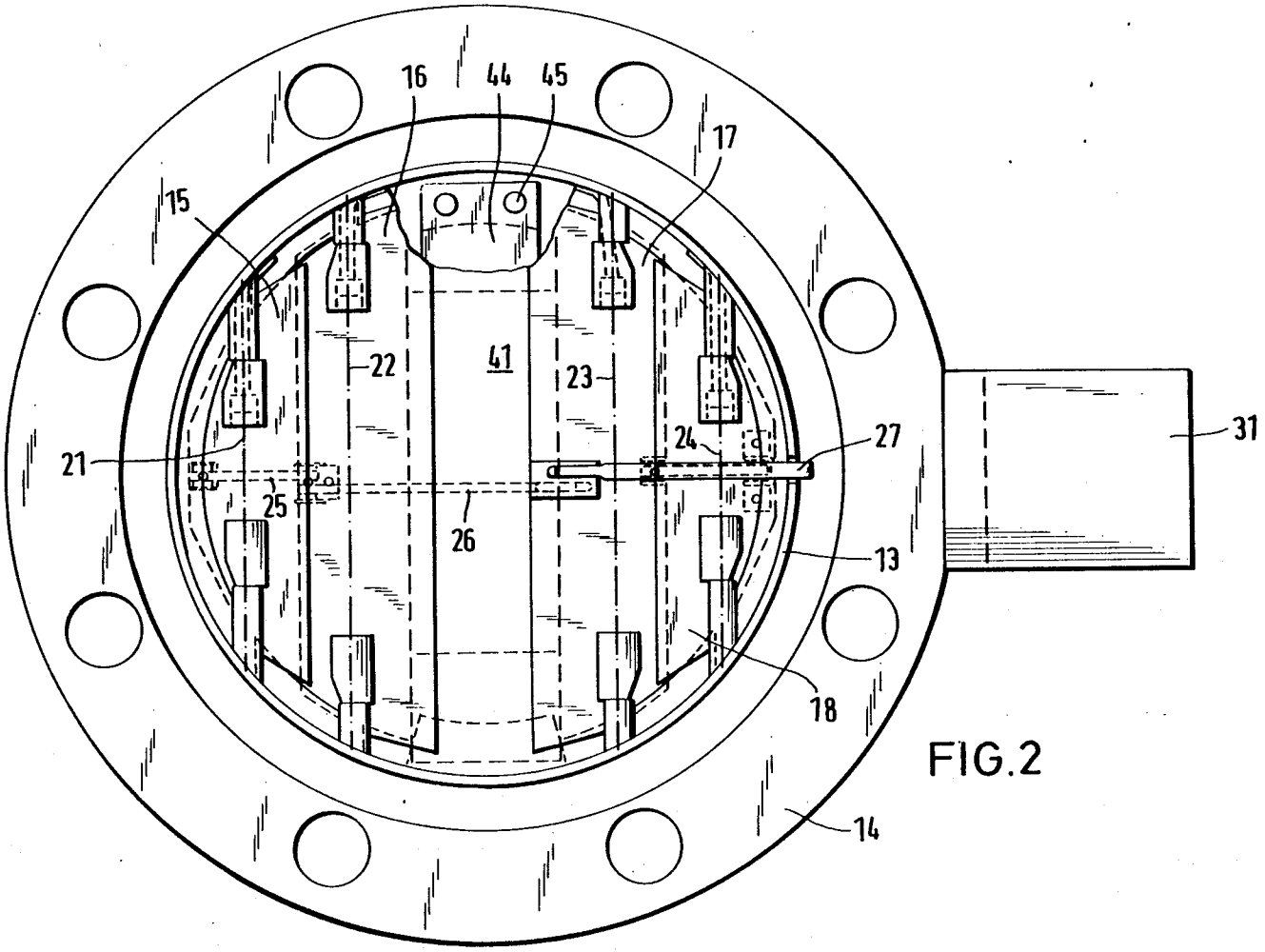
FIG. 2 is a top plan view of the preferred embodiment.

FIG. 1 illustrates the throttle valve in an open position whereas the top plan view of FIG. 2 shows the construction in a closed position. In the closed position the slats 16 and 17 lie on a fixed baffle plate or slat 41 so that the desired hermetic closing properties of the throttle are ensured in its central zone as well. The baffle plate 41 extends generally diametrically across the inlet opening. The end portions of the slats 15–18 and 41 are of arcuate configuration and conform to the inlet opening of the cryopump.

The throttle 3 according to the invention is furthermore so structured that, if used in a cryopump, it is capable of performing two further functions, that is, a pumping function and a usual baffle function. For performing these functions it is necessary that the throttle 3 assume sufficiently low temperatures. For this purpose the frame 13 is held within the flange 14 in a heat insulating manner, for example, by a preferably small number of ceramic pins 42. Further, the frame 13 has engagement faces 43 with which the frame 13 lies against the upper edge of the bowl-shaped pumping surface 5. By virtue of this arrangement the frame 13, the slats 14–18 as well as the stationary baffle plate 41 affixed to the frame 13 assume the temperature of the pumping surface 5 and is thus sufficiently cold for binding vapors by virtue of cryo-condensation. Two U-shaped yokes 44 connected with the slat 41 serve for an additional thermal coupling and are secured by means of screws 45 to the available securing locations (socket 46) on the pumping surface 5 as shown in FIG. 3. The slats 15 and 18 are each contacting the frame 13 thermally by two copper bands 47, as shown in FIG. 1.

The dimensions of the baffle plate 41 as well as the width and pivotal range of the slats 15–18 are so selected that in each position of the throttle 3 the pumping surfaces 4 are protected from a direct heat radiation.

In the described embodiment the rotary axes 21–24 lie externally of the space defined by the cylindrical inner wall of the flange 14, in the direction of the pumping surfaces 4. In this manner a compact construction is feasible. The throttle 3 may replace a conventional fixed baffle usually arranged in this zone. In order to obtain a cryopump for the use of sputtering processes, that is, with an inlet opening which is flow rate-regulatable, it is therefore merely necessary to replace the baffle—which is associated with the inner pumping surfaces and which has immovable baffle slats—with the throttle according to the invention. In this manner a significant prolongation of the paths and additional duct losses for the gases to be pumped are avoided without relinquishing a baffle function.

The present disclosure relates to subject matter contained in European Patent Application No. 87101153.2 (filed Jan. 28, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a cryovacuum pump, including means defining an inlet opening for gases to be pumped, a controllable throttle assembly arranged for varying a flow passage cross section of said inlet opening; the throttle assembly including a flange surrounding said inlet opening; a frame disposed in said inlet opening and being secured to said flange; a plurality of slats each having a longitudinal axis; said slats being supported in said frame and being rotatable therein about respective said longitudinal axes for varying an inclination of said slats and an actuating rod operatively connected to said slats for turning said slats about said respective longitudinal axes; said flange having a throughgoing bore through which said actuating rod passes; the improvement wherein said slats have a substantially constant width along the longitudinal axis thereof; further wherein said longitudinal axes are oriented parallel to one another; further wherein said slats form a first and a second slat group; said actuating rod having a first end being articulated to one of said slats; the improvement further comprising a linkage means connecting said slats with one another for turning the slats forming said first slat group and the slats forming said second slat group in opposite directions upon operating said actuating rod; means defining a chamber situated externally of said inlet opening and communicating with said throughgoing bore; a pivotal lever situated in said chamber and being articulated to a second end of said actuating rod; said pivotal lever projecting outwardly from said chamber; and a swingable bellows supported in said chamber and surrounding said pivotal lever for providing an airtight separation of at least one part of said pivotal lever from said chamber.

2. A cryovacuum pump as defined in claim 1, wherein said linkage means comprises a first link connecting slats of the first group to one another, a second link connecting slats of the second group to one another and a third link connecting a slat of the first slat group with a slat of the second slat group such as to effect said turning of the two slat groups simultaneously in opposite directions.

3. A cryovacuum pump as defined in claim 2, wherein a location of articulation between said one slat and said first end of said actuating rod is on one side of a plane generally containing said longitudinal axes and said first and second links is on another, opposite side of said plane.

4. A cryovacuum pump as defined in claim 3, wherein said flange has an inner cylindrical face surrounding and defining a cylindrical space; further wherein said longitudinal axes are situated externally of said cylindrical space and said location of articulation is situated within said cylindrical space.

5. A cryovacuum pump as defined in claim 1, further comprising securing means of poor heat conducting properties for attaching said frame to said flange; said vacuum pump being a cryopump having a pumping surface; said frame having a face conforming to and being in engagement with said pumping surface.

6. A cryovacuum pump as defined in claim 1, wherein said vacuum pump is a two-stage cryopump having a first pumping surface constituted by an inner face of a bowl-shaped component and adapted for pumping vapors and two parallel-spaced planar second pumping surfaces supported in a space surrounded by said first pumping surface and adapted to pump permanent gases; the improvement wherein said longitudinal axes are oriented parallel to said second pumping surfaces; further comprising securing means of poor heat conducting properties for attaching said frame to said flange; said frame having an outer face conforming to and being in engagement with said first pumping surface at said inlet opening.

7. A cryovacuum pump as defined in claim 6, further comprising copper ribbons, by means of which at least some of said slats are thermally coupled to said frame.

8. A cryovacuum pump as defined in claim 6, further comprising a central stationary baffle strip extending generally diametrally across said inlet opening; heat-conducting yokes bonded to said central stationary baffle strip; and heat-conducting support posts mounted on said first pumping surface; said heat-conducting yokes being secured to said heat-conducting posts.

* * * * *